US006461205B1

(12) United States Patent
Banba et al.

(10) Patent No.: US 6,461,205 B1
(45) Date of Patent: Oct. 8, 2002

(54) HYDRAULIC CIRCUIT OF TILT DEVICE FOR MARINE PROPULSION UNIT

(75) Inventors: Kunio Banba, Gyoda (JP); Yoshimi Watanabe, Gyoda (JP)

(73) Assignee: Showa Corporation, Saitama (JP)

( * ) Notice: Subject to any disclaimer, the term of this patent is extended or adjusted under 35 U.S.C. 154(b) by 0 days.

(21) Appl. No.: 09/949,382

(22) Filed: Sep. 7, 2001

(30) Foreign Application Priority Data

Sep. 8, 2000 (JO) ..... 2000-274030

(51) Int. Cl.[7] ..... B63H 21/26
(52) U.S. Cl. ..... 440/61
(58) Field of Search ..... 440/61, 53, 63, 440/55, 56

(56) References Cited

U.S. PATENT DOCUMENTS 4,702,714 A * 10/1987 Nakase ..... 440/61
4,909,766 A * 3/1990 Taguchi ..... 440/61
4,990,111 A * 2/1991 Saitoh et al. ..... 440/61
5,032,094 A 7/1991 Katogi ..... 440/61
5,049,099 A * 9/1991 Ito et al. ..... 440/61
5,176,093 A * 1/1993 Binversie et al. ..... 440/61
5,215,484 A * 6/1993 Saito ..... 440/61
5,447,456 A * 9/1995 Nakayasu ..... 440/61
5,975,968 A * 11/1999 Nakamura ..... 440/61
6,042,435 A * 3/2000 Nakamura ..... 440/61
6,048,235 A * 4/2000 Kai ..... 440/61
6,062,923 A * 5/2000 Kai ..... 440/61
6,213,822 B1 * 4/2001 Saito et al. ..... 440/61

* cited by examiner

*Primary Examiner*—S. Joseph Morano
*Assistant Examiner*—Lars A. Olson
(74) *Attorney, Agent, or Firm*—Rosenthal & Osha L.L.P.

(57) ABSTRACT

In a hydraulic circuit of a tilt device for a marine propulsion unit provided with a tilt cylinder device and a trim cylinder device, a throttle is provided in a communication passage connecting a first chamber of the trim cylinder device to a tank.

8 Claims, 5 Drawing Sheets

HYDRAULIC CIRCUIT OF TILT DEVICE FOR MARINE PROPULSION UNIT

BACKGROUND OF THE INVENTION

1. Field of the Invention

The present invention relates to a hydraulic circuit of a tilt device for a marine propulsion unit.

2. Description of the Related Art

As a tilt device for a marine propulsion unit, there is a structure in which the marine propulsion unit is supported to a mounting bracket fixed to a hull in a freely tilting manner, a tilt cylinder device supported to a side of the mounting bracket is connected to the marine propulsion unit, and a trim cylinder device supported to a side of the mounting bracket is brought into contact with the marine propulsion unit. In this tilt device, the tilt cylinder device sections a first chamber which receives a piston rod and a second chamber which does not receive the piston rod, by a piston. The piston of the tilt cylinder device is provided with an absorber valve allowing an oil to flow from the first chamber to the second chamber. A trim cylinder device sections a first chamber which receives a piston rod and a second chamber which does not receive the piston rod, by a piston. The tilt device has a working fluid supply/discharge device which extends and contracts the tilt cylinder device and the trim cylinder device so as to tilt the marine propulsion unit by supplying and discharging the working fluid within a tank pressure fed by a pump to the tilt cylinder device and the trim cylinder device.

The working fluid supply/discharge device is provided with a first fluid passage communicating the pump with the first chamber in the tilt cylinder device via a first switching valve and a second fluid passage communicating the pump with the second chamber in the tilt cylinder device via a second switching valve. The working fluid supply/discharge device communicates the first chamber in the trim cylinder device with the tank and communicates the second chamber in the trim cylinder device with the second fluid passage. Further, at a time of tilt-down operation of the pump, the working fluid supply/discharge device opens the first switching valve due to a discharge pressure of the pump and opens the second switching valve due to a line pressure of the first fluid passage so as to make it possible to operate the tilt cylinder device and the trim cylinder device downwardly. Further, at a time of tilt-up operation of the pump, the working fluid supply/discharge device opens the second switching valve due to the discharge pressure of the pump and opens the first switching valve due to the line pressure of the second fluid passage so as to make it possible to operate the tilt cylinder device and the trim cylinder device upwardly.

Accordingly, at a time of tilt-down operation of the marine propulsion unit, the oil discharged from the pump enters into the first chamber of the tilt cylinder device through the first switching valve, and the oil in the second chamber of the tilt cylinder device returns to the pump through the second switching valve so as to contract the tilt cylinder device. When the marine propulsion unit enters into a trim range from a tilt-up range due to the contraction of the tilt cylinder device, the trim cylinder device is brought into contact with the marine propulsion unit so as to be contracted due to a contracting force of the tilt cylinder device, the oil in the second chamber of the trim cylinder device returns to the pump through the second switching valve, and the oil supplied from the tank enters into the first chamber of the trim cylinder device.

Further, at a time of tilt-up operation of the marine propulsion unit, the oil discharged from the pump enters into the second chamber of the tilt cylinder device and the second chamber of the trim cylinder device through the second switching valve, the oil in the first chamber of the tilt cylinder device returns to the pump through the first switching valve, and the oil in the first chamber of the trim cylinder device returns to the tank so as to extend the tilt cylinder device and the trim cylinder device. After the marine propulsion unit reaches the maximum trim-up position within the trim range, the trim cylinder device stays at the maximum up position and only the tilt cylinder device continues the extending operation.

At a time of tilt-lock operation at which the marine propulsion unit is neither tilted down nor tilted up, the operation of the pump is stopped. Accordingly, none of the oil in the first chamber of the tilt cylinder device and the oil in the second chamber can move, whereby the tilt cylinder device can not be extended or contracted, so that the marine propulsion unit is tilt-locked.

Further, if driftwood or the like collides with the marine propulsion unit during forward movement of the hull and an impact force in an extending direction is applied to the tilt cylinder device, the oil in the first chamber of the tilt cylinder device (which becomes highly pressurized) opens the absorber valve in the piston so as to relieve the oil in the first chamber to the second chamber. Accordingly, the tilt cylinder device is immediately extended and the marine propulsion unit jumps into a tilt-up position, whereby the impact force is absorbed.

Accordingly, in the tilt device mentioned above, the tilt cylinder device is not provided with a free piston for returning the piston position after absorbing the impact force generated due to the collision of the driftwood or the like to the piston position before absorbing the impact force, in the second chamber. Accordingly, the tilt cylinder device extending due to the absorption of the impact force is tilted down until the marine propulsion unit is brought into contact with the trim cylinder device or until the trim cylinder is completely expended, due to an empty weight of the marine propulsion unit.

Then, in the process mentioned above in which the tilt cylinder device tilts down due to the empty weight of the marine propulsion unit, the second chamber of the tilt cylinder device is pressurized by the empty weight of the marine propulsion unit, the oil flows into the second chamber of the trim cylinder device connected to the second chamber of the tilt cylinder device by the second oil passage, and the piston rod of the trim cylinder device protrudes until the piston rod is brought into contact with the marine propulsion unit or completely extends. At this time, the oil in the first chamber of the trim cylinder device rapidly returns to the tank, so that an internal pressure of the tank is rapidly increased, whereby there is a risk of a failure such as a breakage to a seal portion of the tank or the like.

SUMMARY OF THE INVENTION

Embodiments of the present invention provide a system to prevent internal pressure of a tank from increasing after absorbing an impact force generated due to a collision with driftwood or the like, in a tilt device for a marine propulsion unit provided with a tilt cylinder device and a trim cylinder device.

In some embodiments, there is provided a hydraulic circuit of a tilt device for a marine propulsion unit in which the marine propulsion unit is supported to a mounting bracket fixed to a hull in a freely tilting manner, a tilt cylinder device is supported to a side of the mounting bracket is connected to the marine propulsion unit, a trim cylinder device supported to a side of the mounting bracket is brought into contact with the marine propulsion unit, the tilt cylinder device is structured such as to section a first chamber which receives a piston rod and a second chamber which does not receive the piston rod, by a piston, and be provided with an absorber valve allowing an oil to flow from the first chamber to the second chamber in the piston and with no free piston in a lower portion of the piston, the trim cylinder device sections a first chamber which receives a piston rod and a second chamber which does not receive the piston rod, by a piston, and the tilt device has a working fluid supply/discharge device which extends and contracts the tilt cylinder device and the trim cylinder device so as to tilt the marine propulsion unit by supplying and discharging the working fluid within a tank pressure fed by a pump to the tilt cylinder device and the trim cylinder device, wherein a throttle is provided in a communicating passage connecting the first chamber of the trim cylinder device to the tank.

In some embodiments, there is provided a hydraulic circuit of a tilt device for a marine propulsion unit in which the marine propulsion unit is supported to a mounting bracket fixed to a hull in a freely tilting manner, a tilt cylinder device is supported to a side of the mounting bracket is connected to the marine propulsion unit, a trim cylinder device supported to a side of the mounting bracket is brought into contact with the marine propulsion unit, the tilt cylinder device is structured such as to section a first chamber which receives a piston rod and a second chamber which does not receive the piston rod, by a piston, and be provided with an absorber valve allowing an oil to flow from the first chamber to the second chamber in the piston and with no free piston in a lower portion of the piston, a trim cylinder device sections a first chamber which receives a piston rod and a second chamber which does not receive the piston rod, by a piston, and the tilt device has a working fluid supply/discharge device which extends and contracts the tilt cylinder device and the trim cylinder device so as to tilt the marine propulsion unit by supplying and discharging the working fluid within a tank pressure fed by a pump to the tilt cylinder device and the trim cylinder device, wherein the first chamber of the trim cylinder device is communicated with the tank, and also with the first chamber of the tilt cylinder device.

BRIEF DESCRIPTION OF THE DRAWINGS

The present invention will be more fully understood from the detailed description given below and from the accompanying drawings which should not be taken to be a limitation on the invention, but are for explanation and understandingly.

Figure 1:
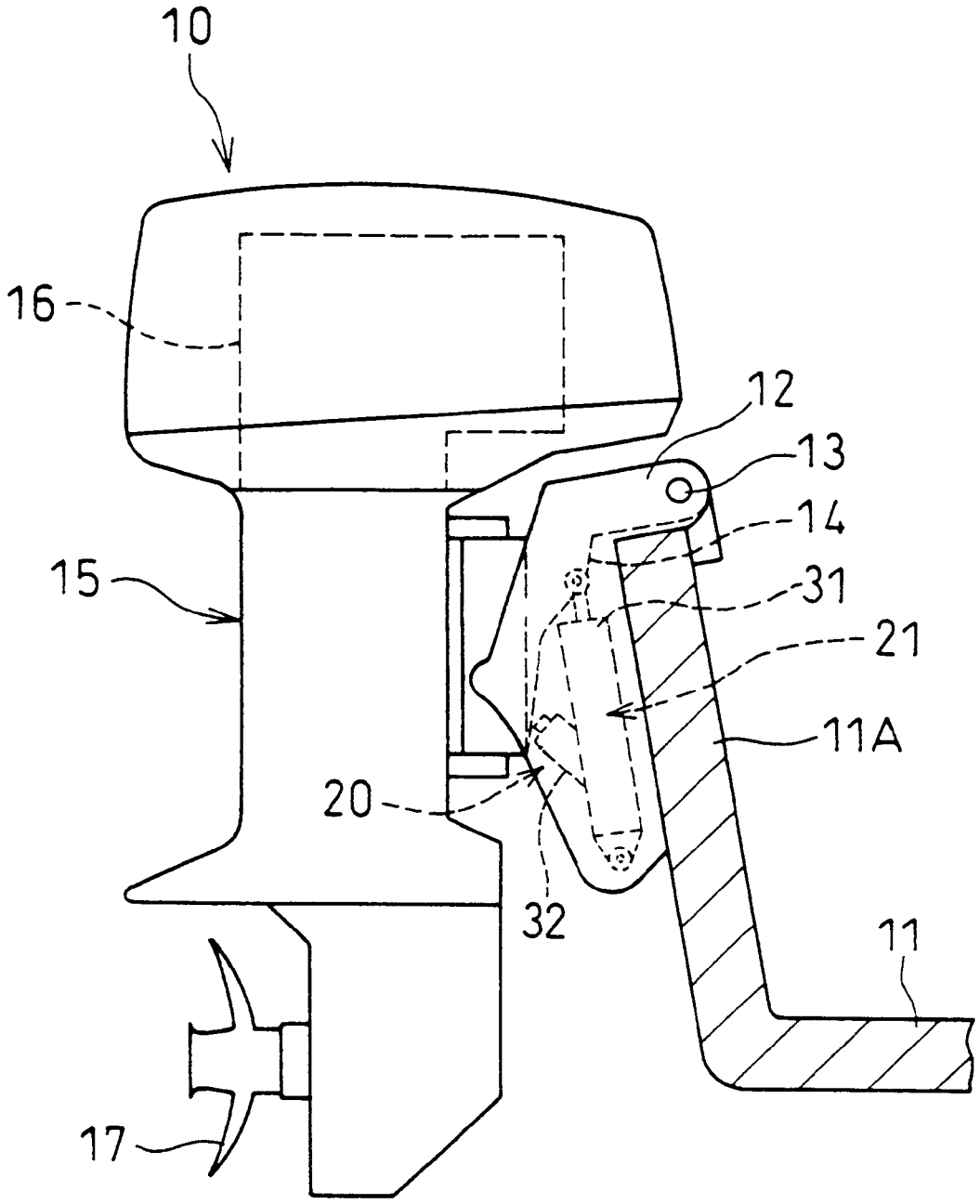
FIG. 1 schematic view showing a marine propulsion unit.
Figure 2:
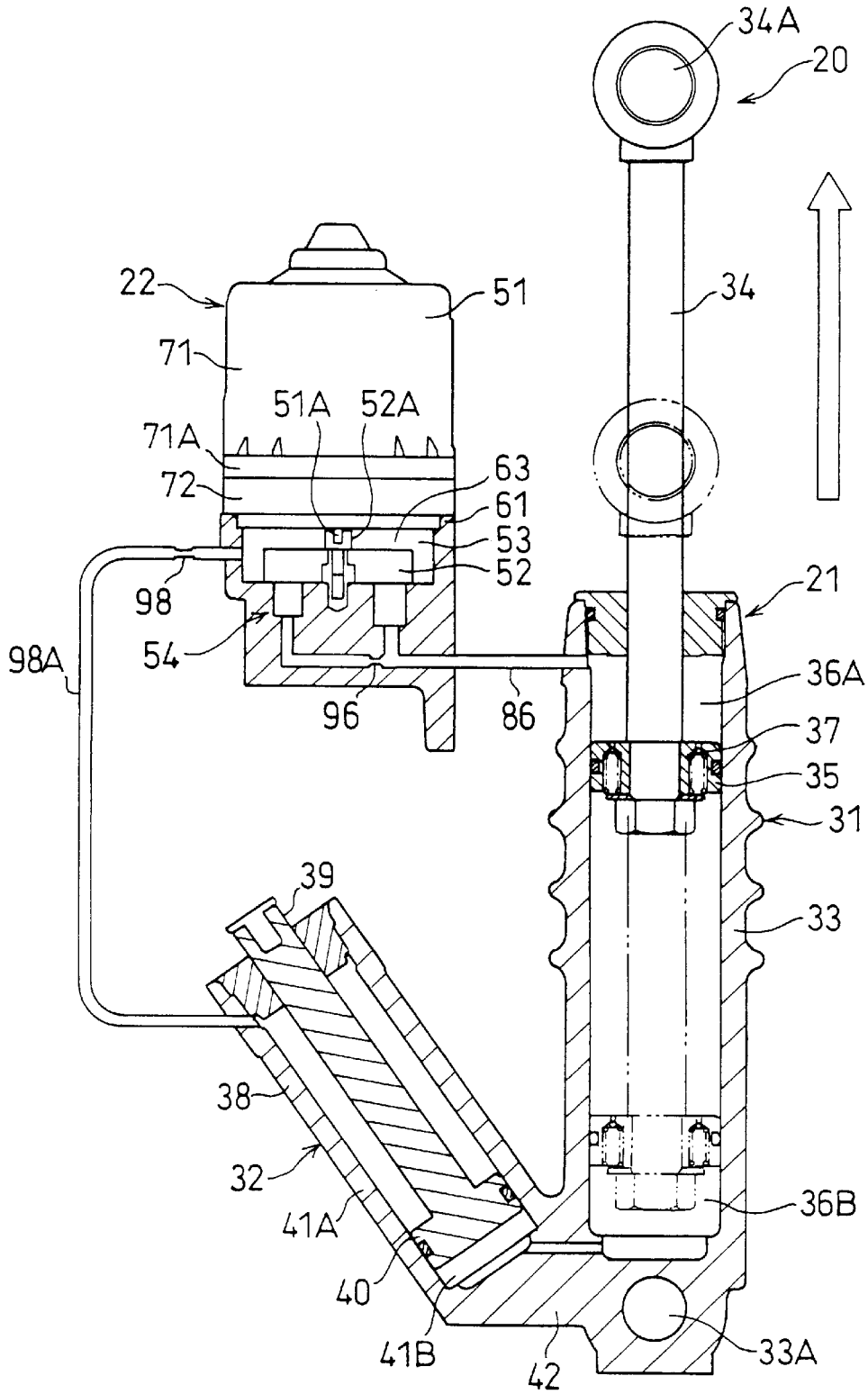
FIG. 2 is a cross sectional view showing a tilt device in accordance with a first embodiment.
Figure 3:
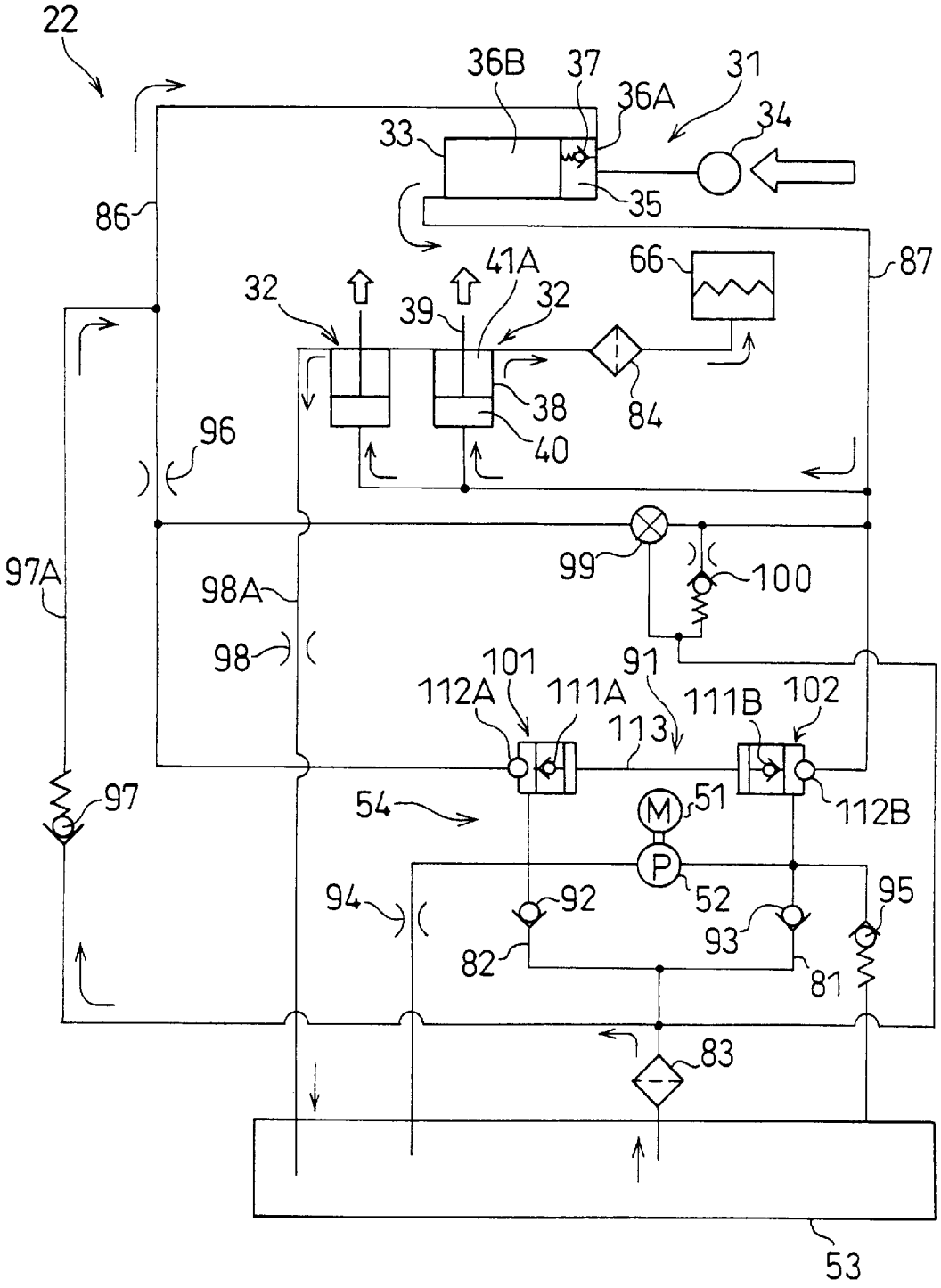
FIG. 3 is a hydraulic circuit diagram of the first embodiment.

DESCRIPTION OF THE PREFERRED EMBODIMENT (First Embodiment) (FIGS. 1 to 3)

A marine propulsion unit 10 (an outboard engine, however, an inboard-outboard engine also may used) is structured such that as shown in FIG. 1. A stern bracket 12 (mounting bracket) is fixed to a stern plate 11A of a hull 11 and a swivel bracket 14 is pivoted to the stern bracket 12 via a tilt shaft 13 so as to be freely tilted around a substantially horizontal axis. A propelling unit 15 is pivoted to the swivel bracket 14 via a vertically arranged rudder shaft (not shown) so as to be rotatable around the rudder shaft. An engine unit 16 is mounted to an upper portion of the propelling unit 15, and a propeller 17 is provided in a lower portion of the propelling unit 15.

The marine propulsion unit 10 is structured such that the propelling unit 15 is supported by the stern bracket 12 fixed to the hull 11 via the tilt shaft 13 and the swivel bracket 14 in a freely tilting manner. A cylinder device 21 of a tilt device 20 is interposed between the stern bracket 12 and the swivel bracket 14, and a working fluid is controlled to be supplied or discharged from a working fluid supply/discharge device 22 to the cylinder device 21, thereby extending and contracting the cylinder device 21 so as to make the propelling unit 15 tilt freely.

(Cylinder Device 21) (FIGS. 2 and 3)

The cylinder device 21 of the tilt device 20 is constituted, as shown in FIGS. 2 and 3, by a central tilt cylinder device 31 and a pair of right and left trim cylinders 32.

The tilt cylinder device 31 is constituted, as shown in FIG. 2, by a cylinder 33 and a piston rod 34, the cylinder 33 is provided with a connection pin inserting and attaching hole 33A to the stern bracket 12, and the piston rod 34 is provided with a connection pin inserting and attaching hole 34A to the swivel bracket 14. The tilt cylinder device 31 is sectioned into a first chamber 36A in a side of receiving the piston rod 34 and a second chamber 36B in a side of receiving no piston rod by a piston 35 fixed to an end portion of the piston rod 34, and is provided with an absorber valve 37 for absorbing an impact force in the piston 35. The absorber valve 37 allows the oil to flow from the first chamber 36A to the second chamber 36B when driftwood or the like comes in contact with the propelling unit 15 during forward movement of the hull 11 so as to make the propelling unit 15 jump up, thereby making it possible to absorb the impact force.

The trim cylinder 32 is constituted, as shown in FIG. 2, by a cylinder 38 and a piston rod 39. The cylinder 38 is integrally formed with the cylinder 33 of the tile cylinder device 31, and the piston rod 39 can be brought into contact with the swivel bracket 14 in a state of being apart from each other. The trim cylinder device 32 is sectioned into a first chamber 41A in a side of receiving the piston rod 39 and a second chamber 41B in a side of receiving no piston rod by a piston 40 fixed to an end portion of the piston rod 39.

The cylinder device 21 is structured such that the cylinder 33 of the tilt cylinder device 31 and the cylinder 38 of the trim cylinder device 32 are integrally formed with a cylinder block 42 constituted by an aluminum alloy casting.

(Working Fluid Supply/Discharge Device 22) (FIG. 2, FIG. 3)

The working fluid supply/discharge device 22 is constituted by a reversible type motor 51, a reversible type gear pump 52, a tank 53 and a flow passage with a switching valve 54. In the present embodiment, a tank housing 61 made of an aluminum alloy casing and forming the tank 53 is connected to one side portion of the cylinder block 42 by a bolt, the tank 53 formed by the tank housing 61 is commonly used as a pump chamber 63, the pump 52 dipped into the pump chamber 63 is fixed to the tank housing 61 by the bolt, and an end plate 72 mentioned below of the motor 51 is fixed to the tank housing 61 by a bolt so as to close an upper opening of the pump chamber 63 by the end plate 72. Further, the reservoir tank 66 is fixed to another side portion of the cylinder block 42 by a bolt. Further, the pump 52, the tank 53 (66), the first and second chambers 36A and 36B of the tilt cylinder device 31 and the first and second chambers 41A and 41B of the trim cylinder device 32 are connected in a manner shown in FIG. 3 by the cylinder block 42 and the flow passage with the switching vale 54 pierced in the tank housing 61.

In the motor 51, an outer hull is constituted by an outer case 71 formed in a cylindrical shape with a top and an end plate 72 hermetically sealing a lower end opening of the outer case 71 as shown in FIG. 2. The motor 51 is structured such that a flange 71A of the outer case 71 is fixed to the housing 61 mentioned above together with the end plate 72 by a bolt in a liquid tight manner. Further, the output shaft 51A of the motor 51 passes through the end plate 72 in a liquid tight manner and is connected to a driven shaft 52A of the pump 52 in the pump chamber 63 commonly used as the tank 53.

The pump 52 is arranged so as to be dipped into the pump chamber 63 (the tank 53) formed by the tank housing 61 as mentioned above. A suction port 81 for tilting up and a suction port 82 for tilting down are opened to the pump chamber 63 (the tank 53) via a filter 83 so that the pump 52 can pressure feed a working fluid sucked from the tank 53 to the fluid passage 54 with the switching valve under a normal and inverse rotation of the motor 51.

As shown in FIG. 3, the flow passage 54 with the switching valve is provided with a first fluid passage 86 and a second fluid passage 87 which respectively communicate the pump 52 with the first chamber 36A and the second chamber 36B of the tilt cylinder device 31, thereby communicating an intermediate portion of the second fluid passage 87 with the second chamber 41B of the trim cylinder device 32. In this case, the first chamber 41A of the trim cylinder device 32 is connected to the reservoir tank 66 via a filter 84. At this time, the flow passage 54 with the switching valve is provided with a shuttle type switching valve 91, check valves 92 and 93, a down blow valve 94, an up blow valve 95, a throttle 96, a check valve 97, a throttle 98, a manual valve 99 and a thermal blow valve 100.

The switching valve 91 is constituted by a first switching valve 101 interposed in the first fluid passage 86 and a second switching valve 102 interposed in the second fluid passage 87. The first switching valve 101 is constituted by a spool 111A with a first check mechanism and a first check valve 112A, and the second switching valve 102 is constituted by a spool 111B with a second check mechanism and a second check valve 112B. The spool 111A and the spool 111B are connected by a flow passage 113. At a time of the tilt-down operation (at a time of normal rotation) of the pump 52, the first check valve 112A of the first switching valve 101 is opened due to a discharge pressure, and a line pressure of the first fluid passage 86 moves the spool 111B with the second check mechanism via the check mechanism of the spool 111A with the first check mechanism so as to open the second check valve 112B of the second switching valve 102 in an opposite side, whereby the tilt cylinder device 31 and the trim cylinder device 32 can be downward operated. Further, at a time of the tilt-up operation (at a time of reverse rotation) of the pump 52, the second check valve 112B of the second switching valve 102 is opened due to a discharge pressure thereof, and a line pressure of the second fluid passage 87 moves the spool 111A with the first check mechanism via the check mechanism of the spool 111B with the second check mechanism so as to open the first check valve 112A of the first switching valve 101 in an opposite side, whereby the tilt cylinder device 31 and the trim cylinder device 32 can be upward operated.

The check valve 92 is interposed in a middle portion between the pump 52 and the tank 53, and is structured so as to compensate for an insufficient amount of a circulating fluid from the tank 53 to the pump 52 in accordance with the opening operation of the check valve 92, the insufficiency of the circulating amount of the working fluid being caused by an increase of an internal capacity of the cylinders 33 and 38 corresponding to a protruding capacity of the piston rods 34 and 39 at a time of the tilt-up operation of the cylinder device 21.

The check valve 93 is interposed in the middle portion between the pump 52 and the tank 53, and is structured such as to supply the working fluid from the tank 53 to the pump 52 in accordance with the opening operation of the check valve 93 in the case that the pump 52 keeps operating when the tilt-down operation is completed at a time of finishing the tilt-down operation of the cylinder device 21 and a return fluid from the second chambers 36B and 41B to the pump 52 is lost.

The down-blow valve 94 is constituted by a throttle, and is structured so as to return surplus working fluid to the tank 53. The surplus working fluid is generated in an amount of circulating fluid due to the matter that the internal capacity of the cylinders 33 and 38 is reduced at a forward moving capacity of the piston rods 34 and 39 at a time of the tilt-down operation of the cylinder device 21.

The up-blow valve 95 is structured such as to return a surplus working fluid to the tank 53 when the tilt cylinder device 31 becomes in an extending state and then the pump 52 is operated even after the tilt-up operation is completed at a time of the tilt-up operation of the cylinder device 21.

The throttle 96 is interposed in the first fluid passage 86, and increases and secures the line pressure of the first fluid passage 86 required for opening the second switching valve 102 at a time of the tilt-down operation by the pump 52.

The check valve 97 is interposed in a communication passage 97A connecting the first chamber 36A of the tilt cylinder device 31 to the tank 53, allows the fluid to flow from the tank 53 to the first chamber 36A, and can smoothly supply the fluid corresponding to the capacity of the piston rod 34 moving out of the tilt cylinder device 31 to the first chamber 36A from the tank 53 when the tilt cylinder device 31 extends so as to make it possible to jump up the marine propulsion unit 10 at a time of absorbing the impact force caused by a collision with driftwood or the like. At this time, if the communication passage 97A provided with the check valve 97 is connected to the first chamber 36A of the tilt cylinder device 31 via the throttle 96 mentioned above, the fluid supplied to the first chamber 36A from the tank 53 via the check valve 97 does not smoothly flow due to the throttle 96 provided in the middle. In accordance with the present invention, it is possible to smoothly flow the fluid supplied to the first chamber 36A from the tank 53 by connecting the communication passage 97A provided with the check valve 97 to the first chamber 36A of the tilt cylinder device 31 without passing through the throttle 96.

In this case, the check valve 97 is provided with a spring and a fixed set load is applied to the check valve 97. Since the check valve does not accidentally open at a time of the tilt-down operation, the fluid is supplied to the first chamber only by the pump, and no unnecessary fluid is supplied, the tilt-down operation becomes a stable operation (that is, a tilt-down speed does not change).

The throttle 98 is interposed in a communication passage 98A connecting the first chamber 41A of the trim cylinder device 32 to the tank 53. In a process that the tilt cylinder device 31 is contracted due to the empty weight of the marine propulsion unit 10 when the tilt cylinder device 31 is jumped up at a time of absorbing the impact force caused by a collision, the second chamber 41B of the trim cylinder device 32 is pressurized together with the second chamber 36B of the tilt cylinder device 31. As a result, when the fluid in the first chamber 41A of the trim cylinder device 32 is rapidly discharged, the existence of the throttle 98 prevents the fluid from rapidly flowing into the tank 53.

The manual valve 99 is structured such as to manually operated at a time when the tilt device 20 is out of order or the like. The manual valve 99 returns the working fluid in the second chambers 36B and 41B of the cylinder device 21 to the tank 53, manually contracts the cylinder device 21 as well as the fluid sucking operation of the check valve 97, and makes it possible to manually tilt down the propelling unit 15.

The thermal blow valve 100 serves a thermal blow function of releasing the working fluid to the tank 53 when the capacity of the working fluid in the second chambers 36B and 41B of the cylinder device 21 and second fluid passage 87 is increased due to the temperature change.

A description will be given below of a basic operation of the tilt device 20.

(1) Tilt up

When reverse rotating the motor 51 and the pump 52 so as to operate upwardly, the discharge fluid of the pump 52 opens the second check valve 112B of the second switching valve 102, and the line pressure of the second fluid passage 87 also opens the first check valve 112A via the spools 111B and 111A. Accordingly, the discharge pressure of the pump 52 is supplied to the second chamber 36B of the tilt cylinder 31 through the second check valve 112B and the second fluid passage 87, and the working fluid in the first chamber 36A is returned to the pump 52 through the first fluid passage 86 and the first check valve 112A so as to extend the tilt cylinder device 31.

At the same time of the tilt-up operation of the tilt cylinder device 31, the working fluid supplied to the second fluid passage 87 is supplied to the second chamber 41B of the trim cylinder device 32 so as to trim up the trim cylinder device 32. In this case, the working fluid in the first chamber 41A of the trim cylinder device 32 is returned to the tanks 53 and 66.

After the propelling unit 15 reaches the maximum trim-up position in accordance with the upward operation mentioned above of the tilt cylinder device 31 and the trim cylinder device 32, only the piston rod 34 of the tilt cylinder device 31 extends at a faster speed so as to tilt up the propelling unit 15 to the maximum tilt-up position.

(2) Tilt down

When normally rotating the motor 51 and the pump 52 so as to operate downwardly, the discharge fluid of the pump 52 opens the first check valve 112A of the first switching valve 101, and the line pressure of the first fluid passage 86 increased by the throttle 96 also opens the second check valve 112B via the spools 111A and 111B. Accordingly, the discharge pressure of the pump 52 is supplied to the first chamber 36A of the cylinder 21 through the first check valve 112A and the first fluid passage 86, and the working fluid in the second chamber 36B of the cylinder device 21 is returned to the pump 52 through the second fluid passage 87 and the second check valve 112B so as to contract the tilt cylinder device 31.

At a middle process of the tilt-down operation of the tilt cylinder device 31, after the swivel bracket 14 is brought into contact with the piston rod 39 of the trim cylinder device 32, the trim cylinder device 32 is also contracted so as to be trimmed down.

(3) Collision with driftwood or the like

When driftwood or the like is brought into contact with the propelling unit 15 during forward movement of the hull 11, and an impact force in the extending direction is applied to the tilt cylinder device 31, the pressure of the fluid in the first chamber 36A of the tilt cylinder device 31 opens the absorber valve 37 in the piston 35 so as to release the fluid in the first chamber 36A to the second chamber 36B. As a result, the tilt cylinder device 31 is immediately extended so as to cause the propelling unit 15 to jump to the maximum tilt-up position side and absorb the impact force. At this time, the fluid corresponding to the capacity of the piston rod 34 moving out of the tilt cylinder device 31 is supplemented by the fluid absorbed to the first chamber 36A from the tank 53 via the check valve 97.

Since the trim cylinder device 32 becomes free when the tilt cylinder device 31 is jumped up in accordance with the absorption of the impact force, the tilt cylinder device 31 after jumping up tilts down until the swivel bracket 14 is brought into contact with the piston rod 39 of the trim cylinder device 32 or the trim cylinder is completely extended due to the empty weight of the propelling unit 15. In this process, the second chamber 36B of the tilt cylinder device 31 is pressurized due to the empty weight of the propelling machine and the fluid flows into the second chamber 41B of the trim cylinder device 32 connected to the second chamber 36B of the tilt cylinder device 31 by the second fluid passage 87. Accordingly, the piston rod 39 of the trim cylinder device 32 protrudes out until being brought into contact with the swivel bracket 14 or completely extending. At this time, the fluid in the first chamber 41A of the trim cylinder device 32 is discharged to the tank 53 from the communication passage 98A via the throttle 98 so as to prevent the internal pressure of the tank 53 from being rapidly increased due to the existence of the throttle 98.

In accordance with the present embodiment, the following effects can be obtained.

(1) The throttle 98 is provided in the communication passage 98A connecting the first chamber 41A of the trim cylinder device 32 to the tank 53. Accordingly, in the process that the tilt cylinder device 31 jumping up at a time of absorbing the impact force generated by a collision with driftwood or the like tilts down due to the empty weight of the marine propulsion unit 10, the second chamber 41B of the trim cylinder device 32 is pressurized together with the second chamber 36B of the tilt down device 31, so that when the fluid in the first chamber 41A of the trim cylinder device 32 is rapidly discharged, it is possible to prevent the fluid from rapidly flowing into the tank 53 by the existence of the throttle 98 mentioned above and it is possible to prevent the internal pressure of the tank 53 from being increased and further prevent the seal portion or the like in the tank 53 (the seal portion of the end plate 72 of the motor 51 corresponding to the lid of the tank 53, the seal portion of the reservoir tank 66 and the like) from being deteriorated.

(2) The throttle 96 provided in the first fluid passage 86 increases the line pressure of the first fluid passage 86 required for opening the second switching valve 102 at a time of tilting down the pump 52 and keeps the pressure so as to securely open the second switching valve 102.

The check valve 97 provided in the communication passage 97A connecting the first chamber 36A of the tilt cylinder device 31 to the tank 53 can smoothly supplement the fluid corresponding to the capacity of the piston rod 34 moving out of the tilt cylinder device 31 to the first chamber 36A from the tank 53 at a time when the tilt cylinder device 31 extends at a time of absorbing the impact force generated by a collision with driftwood or the like so as to make it possible to jump up the marine propulsion unit 10, thereby making the tilt cylinder device 31 smoothly extend.

At this time, if the communication passage 97A provided with the check valve 97 mentioned above is connected to the first chamber 36A of the tilt cylinder device 31 via the throttle 96 mentioned above, the fluid supplied to the first chamber 36A from the tank 53 via the check valve 97 does not smoothly flow due to the throttle 96 disposed in the middle thereof. It is possible to smoothly flow the fluid supplied from the tank 53 to the first chamber 36A by connecting the communication passage 97A provided with the check valve 97 to the first chamber 36A of the tilt cylinder device 31 without passing through the throttle 96.

(3) A set load is applied to the check valve 97 provided in the communication passage 97A connecting the first chamber 36A of the tilt cylinder device 31 to the tank 53. Since the check valve does not accidentally open at a time of the tilt-down operation, the fluid is supplied to the first chamber only by the pump and no insufficient fluid is supplied, the tilt-down operation is stably performed (that is, the tiltdown speed does not change).

Figure 4:
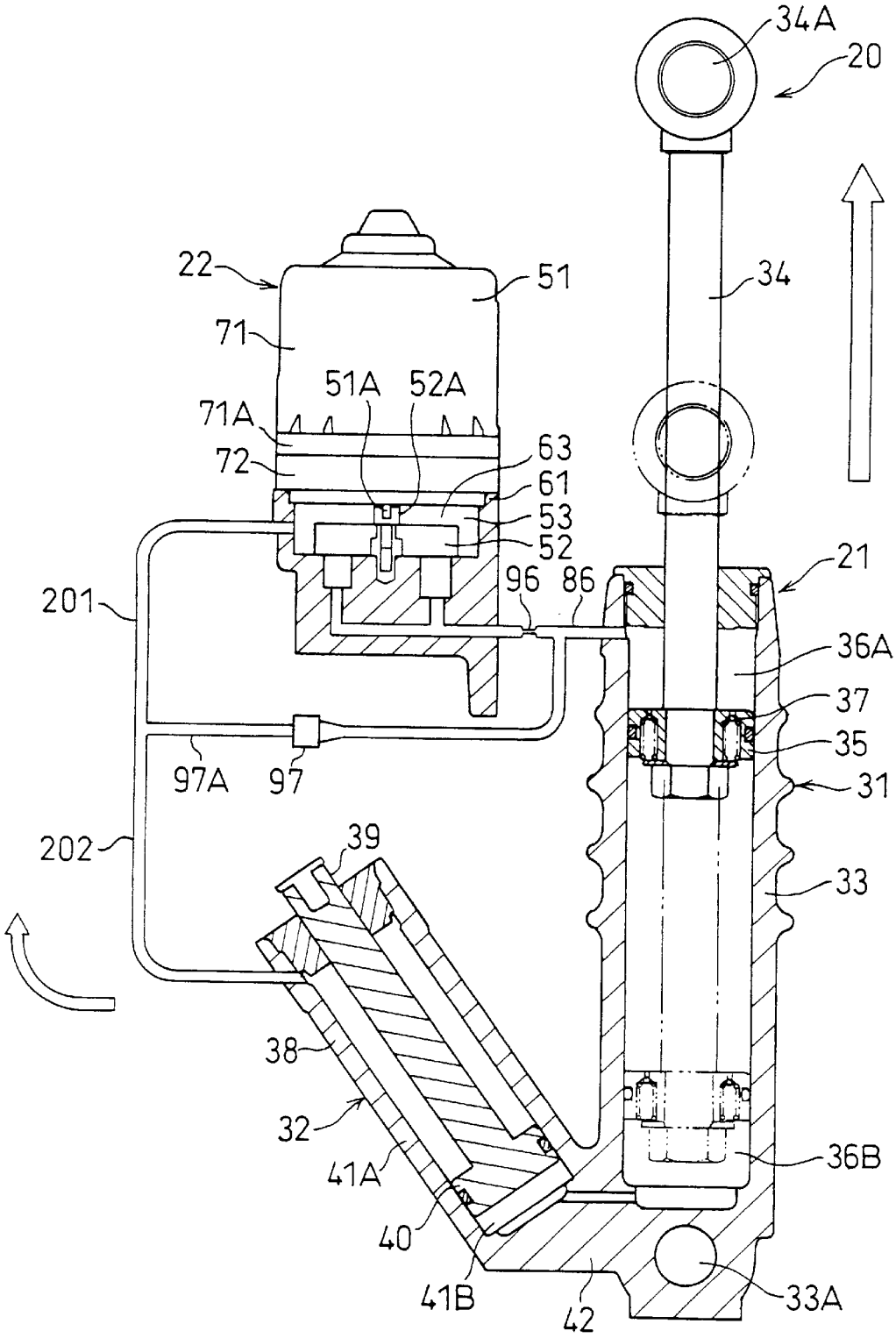
FIG. 4 is a cross sectional view showing a tilt device in accordance with a second embodiment.
Figure 5:
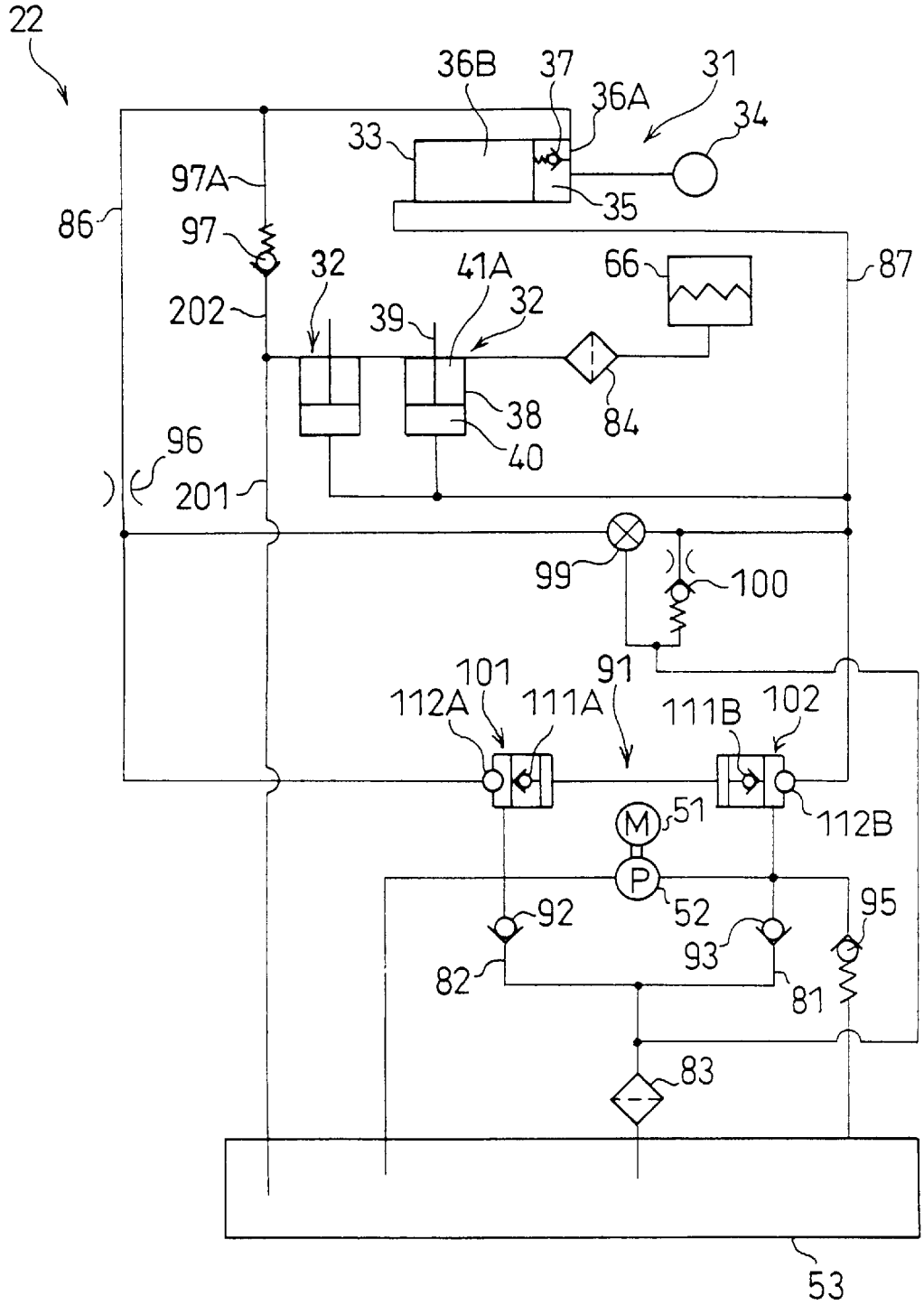
FIG. 5 is a hydraulic circuit diagram of the second embodiment.

(Second Embodiment) (FIGS. 4 and 5)

A point at which the second embodiment is substantially different from the first embodiment is that in the flow passage with the switching valve 54 of the working fluid supply/discharge device 22, in place of employing the communication passage 98A and the throttle 98 in the first embodiment, the first chamber 41A of the trim cylinder device 32 is communicated with the tank 53 by a communication passage 201 and also with the first chamber 36A of the tilt cylinder device 31 by a communication passage 202. In accordance with the present embodiment, the communication passage 97A of the check valve 97 connecting the first chamber 36A of the tilt cylinder device 31 to the tank 53 is commonly used for the communication passages 201 and 202 mentioned above.

In accordance with the present embodiment, the first chamber 41A of the trim cylinder device 32 is communicated with the tank 53 and also with the first chamber 36A of the tilt cylinder device 31. Accordingly, in the process that the tilt cylinder device 31 jumps up at a time of absorbing the impact force generated by a collision and then tilts down due to the empty weight of the marine propulsion unit 10, the second chamber 41B of the trim cylinder device 32 is pressurized together with the second chamber 36B of the tilt cylinder device 31. As a result, the structure is made such that when the fluid in the first chamber 41A of the trim cylinder device 32 is rapidly discharged, the fluid flows not only to the tank 53 but also to the first chamber 36A of the tilt cylinder device 31. Accordingly, it is possible to prevent the fluid from rapidly flowing into the tank 53, and it is possible to prevent the internal pressure of the tank 53 from being increased and further prevent the seal portion of the tank 53 or the like (the seal portion of the end plate 72 of the motor corresponding to the lid of the tank 53, the seal portion of the reservoir tank 66 and the like) from being deteriorated.

As heretofore explained, embodiments of the present invention have been described in detail with reference to the drawings. However, the specific configurations of the present invention are not limited to the embodiments but those having a modification of the design within the range of the present invention are also included in the present invention.

As mentioned above, in accordance with the present invention, in the tilt device for the marine propulsion unit provided with the tilt cylinder device and the trim cylinder device, it is possible to prevent the internal pressure of the tank from being increased after absorbing the impact force generated by the collision of the driftwood or the like.

Although the invention has been illustrated and described with respect to several exemplary embodiments thereof, it should be understood by those skilled in the art that the foregoing and various other changes, omissions and additions may be made to the present invention without departing from the spirit and scope thereof Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A hydraulic circuit of a tilt device for a marine propulsion unit comprising:

the marine propulsion unit being supported to a mounting bracket fixed to a hull in a freely tilting manner, a tilt cylinder device being supported to a side of the mounting bracket is connected to the marine propulsion unit, and a trim cylinder device supported to a side of the mounting bracket being brought into contact with the marine propulsion unit;

the tilt cylinder device being structured such as to section a first chamber which receives a piston rod and a second chamber which does not receive the piston rod, by a piston, and be provided with an absorber valve allowing an oil to flow from the first chamber to the second chamber in the piston and with no free piston in a lower portion of the piston;

the trim cylinder device sectioning a first chamber which receives a piston rod and a second chamber which does not receive the piston rod, by a piston; and a working fluid supply/discharge device which extends and contracts the tilt cylinder device and the trim cylinder device so as to tilt the marine propulsion unit by supplying and discharging the working fluid within a tank pressure fed by a pump to the tilt cylinder device and the trim cylinder device, wherein a throttle is provided in a communicating passage connecting the first chamber of the trim cylinder to the tank.

2. A hydraulic circuit of a tilt device for a marine propulsion unit as claimed in claim 1, wherein the working fluid supply/discharge device is provided with a first fluid passage communicating the pump with the first chamber of the tilt cylinder device via the first switching valve and a second fluid passage communicating the pump with the second chamber of the tilt cylinder device via the second switching valve, so as to communicate the first chamber of the trim cylinder device with the tank and communicate the second chamber of the trim cylinder device with the second fluid passage, wherein the working fluid supply/discharge device respectively opens the first switching valve and the second switching valve due to the discharge pressure of the pump 52 and the line pressure of the first fluid passage at a time of the tilt-down operation of the pump so as to make it possible to downward operate the tilt cylinder device and the trim cylinder device, and wherein the working fluid supply/discharge device respectively opens the second switching valve and the first switching valve due to the discharge pressure of the pump and the line pressure of the second fluid passage at a time of the tilt-up operation of the pump so as to make it possible to upward operate the tilt cylinder device and the trim cylinder device.

3. A hydraulic circuit of a tilt device for a marine propulsion unit as claimed in claim 2, wherein a throttle is provided in the first fluid passage, and wherein at a time of providing a check valve allowing the fluid to flow from the tank to the first chamber in the communication passage connecting the first chamber of the tilt cylinder device with the tank, the communication passage provided with the check valve is connected to the first chamber without passing through the throttle.

4. A hydraulic circuit of a tilt device for a marine propulsion unit as claimed in claim 3, wherein a fixed set load is applied to the check valve provided in the communication passage.

5. A hydraulic circuit of a tilt device for a marine propulsion unit comprising:

the marine propulsion unit being supported to a mounting bracket fixed to a hull in a freely tilting manner, a tilt cylinder device being supported to a side of the mounting bracket is connected to the marine propulsion unit, and a trim cylinder device supported to a side of the mounting bracket being brought into contact with the marine propulsion unit;

the tilt cylinder device being structured such as to section a first chamber which receives a piston rod and a second chamber which does not receive the piston rod, by a piston, and be provided with an absorber valve allowing an oil to flow from the first chamber to the second chamber in the piston and with no free piston in a lower portion of the piston;

the trim cylinder device sectioning a first chamber which receives a piston rod and a second chamber which does not receive the piston rod, by a piston; and a working fluid supply/discharge device which extends and contracts the tilt cylinder device and the trim cylinder device so as to tilt the marine propulsion unit by supplying and discharging the working fluid within a tank pressure fed by a pump to the tilt cylinder device and the trim cylinder device, wherein the first chamber of the trim cylinder device is communicated with the tank, and also with the first chamber of the tilt cylinder device.

6. A hydraulic circuit of a tilt device for a marine propulsion unit as claimed in claim 5, wherein the working fluid supply/discharge device is provided with a first fluid passage communicating the pump with the first chamber of the tilt cylinder device via the first switching valve and a second fluid passage communicating the pump with the second chamber of the tilt cylinder device via the second switching valve, so as to communicate the first chamber of the trim cylinder device with the tank and communicate the second chamber of the trim cylinder device with the second fluid passage, wherein the working fluid supply/discharge device respectively opens the first switching valve and the second switching valve due to the discharge pressure of the pump 52 and the line pressure of the first fluid passage at a time of the tilt-down operation of the pump so as to make it possible to downward operate the tilt cylinder device and the trim cylinder device, and wherein the working fluid supply/discharge device respectively opens the second switching valve and the first switching valve due to the discharge pressure of the pump and the line pressure of the second fluid passage at a time of the tilt-up operation of the pump so as to make it possible to upward operate the tilt cylinder device and the trim cylinder device.

7. A hydraulic circuit of a tilt device for a marine propulsion unit as claimed in claim 6, wherein a throttle is provided in the first fluid passage, and wherein at a time of providing a check valve allowing the fluid to flow from the tank to the first chamber in the communication passage connecting the first chamber of the tilt cylinder device with the tank, the communication passage provided with the check valve is connected to the first chamber without passing through the throttle.

8. A hydraulic circuit of a tilt device for a marine propulsion unit as claimed in claim 7, wherein a fixed set load is applied to the check valve provided in the communication passage.

* * * * *